United States Patent [19]

Poulsen

[11] Patent Number: 5,046,564

[45] Date of Patent: Sep. 10, 1991

[54] HIGH VELOCITY FIRE FIGHTING NOZZLE

[76] Inventor: Thomas E. Poulsen, Box 19, Jiggs, Nev. 89801

[21] Appl. No.: 490,519

[22] Filed: Mar. 1, 1990

Related U.S. Application Data

[63] Continuation of Ser. No. 363,415, Jun. 5, 1989, abandoned, which is a continuation of Ser. No. 225,646, Jul. 25, 1988, abandoned, which is a continuation of Ser. No. 882,605, Jul. 7, 1986, abandoned.

[51] Int. Cl.[5] ..... A62C 3/02; A62C 39/00

[52] U.S. Cl. ..... 169/47; 169/12; 169/46; 169/52; 169/70

[58] Field of Search ..... 169/47, 70, 91, 52, 169/24, 14, 15, 53, 12, 46

[56] References Cited

U.S. PATENT DOCUMENTS

| | | | |
|---|---|---|---|
| 1,598,568 | 8/1926 | Fields | 169/52 |
| 1,737,895 | 12/1929 | Sachsenmaier | 239/418 X |
| 2,756,097 | 7/1956 | Brandau et al. | 239/2.1 X |
| 2,891,624 | 6/1959 | McBride | 169/91 X |
| 3,033,292 | 5/1962 | Browning | 169/12 X |
| 3,128,036 | 4/1964 | McBride | 169/52 X |
| 3,431,742 | 3/1969 | Green | 60/39.48 X |
| 3,606,971 | 9/1971 | Harrison et al. | 239/14.1 |
| 3,640,083 | 2/1972 | Galbraith et al. | 60/39.48 X |
| 4,099,572 | 7/1978 | Vasilenko et al. | 169/12 |
| 4,105,161 | 8/1978 | Kircher et al. | 239/2.2 |
| 4,113,019 | 9/1978 | Sobolev et al. | 169/12 |

FOREIGN PATENT DOCUMENTS

| | | | |
|---|---|---|---|
| 139340 | 9/1949 | Australia | 239/77 |
| 2432872 | 4/1980 | France | 169/53 |
| 1090312 | 5/1984 | U.S.S.R. | 239/77 |
| 1314995 | 6/1987 | U.S.S.R. | 169/14 |
| 908890 | 10/1962 | United Kingdom | 169/12 |

*Primary Examiner*—Margaret A. Focarino
*Assistant Examiner*—James M. Kannofsky

[57] ABSTRACT

A fire fighting device consisting of a jet engine, or alternatively another wind-producing mechanism, with a conduit mounted thereon, the conduit having an opening so that when water or another fire retardant is directed into the conduit, the water or other fire retardant will exit the opening and enter the jet exhaust when the jet engine is in operation. The jet exhaust will carry the water or other fire retardant for a long distance, thus enabling fire fighters to propel the water or other fire retardant to distant parts of a wildfire by aiming the jet exhaust above the fire. Preferably, the jet engine is mounted in a manner allowing rotation on horizontal and vertical axes to allow it to be aimed.

13 Claims, 6 Drawing Sheets

HIGH VELOCITY FIRE FIGHTING NOZZLE

This application is a continuation of Ser. No. 07/363,415, filed June 5, 1989, now abandoned, which is a continuation of Ser. No. 07/225,646, filed July 25, 1988, now abandoned, which is a continuation of Ser. No. 06/882,605, filed July 7, 1986, now abandoned.

BACKGROUND OF THE INVENTION

This invention relates to fire fighting equipment, especially that used in wildland fire fighting.

An important technique used in fighting wildland fires entails the familiar method of pumping water on the fire with fire hose and nozzle. In the many areas where the terrain will not permit access to all parts of a fire with a fire truck, it is often necessary for fire fighters to lay successive links of fire hose on foot in order to reach all portions of the blaze. This process is relatively slow, especially in steep or rough terrain, and the fire will very often outpace the fire fighters attempts to control it. Many major fires result because fire fighters were unable to control the fire when they were still relatively small.

Because of these difficulties encountered by fire fighters working on the ground, airplanes and helicopters are often used to drop water or other fire retardants on wildland fires. Aircraft have been used very successfully in this way, but their effectiveness is somewhat limited by the fact that, after a drop, the aircraft must return to its source of water or fire retardant to pick up another load. This return trip is often quite time consuming, leaving the fire to burn for relatively long intervals between attacks from the aircraft.

A major innovation in wildland fire fighting could be made if a steady stream of water or other fire retardants could be propelled through the air for long distances. Such a capability would enable fire fighters, working from one location on the ground, to direct a steady supply of water or other fire retardants to distant parts of a wildfire. This ability may prove decisive in controlling many fires at a relatively early stage that otherwise would have become much larger. Likewise, fires which have already reached major proportions may be effectively combated with such a device.

Conventional methods of propelling water for the purpose of fire fighting consist of pumping it under pressure through a nozzle. Distances attained by this method are limited, however, because wind resistance quickly breaks up the stream of water into droplets, to which the wind offers even greater resistance. Where comparatively long distances of propelling water have been attained by this method, it has been by pumping the water at a very high rate and pressure. But even then, the distances attained by this method are not great, and the rate at which the water is used up would often be unacceptable in wildland fire fighting due to a limited availability of water.

Accordingly, it is an object of the present invention to provide a process for, and a device to propel water or other fire retardants long distances through the air. Futhermore, it is an object to provide such a process and a device that need not rely on expending the water or other fire retardant at a very fast rate in order to be propelled long distances. Another object of the present invention is to provide such a process, and such a device that may be aimed in order to direct the water or other fire retardant at a desired location onto a fire, or in front of a fire. A still further object of the present invention is to provide such a device that may be readily transported to a location near a fire.

SUMMARY OF THE INVENTION

In its preferred embodiment, this invention consists primarily of a jet engine with a pipe or hose mounted indirectly thereon. The pipe or hose has an open portion or a nozzle and is positioned so that when water or another fire retardant passes through the pipe or hose, under sufficient pressure, the water or other fire retardant will exit through the open portion or nozzle and enter the jet exhaust when the jet engine is in operation.

A jet engine has the capability to produce an exhaust that can be measured as a relatively high velocity wind at a relatively long distance from the engine itself. Water or other fire retardants passing into this exhaust can therefore be carried for relatively long distances through the air.

If the exhaust of the jet engine is aimed into the air above a wildfire, the water or other fire retardants carried by the jet exhaust will travel with the exhaust for some distance until the velocity of the jet exhaust decreases to a point where it can no longer carry the water or other fire retardant. At this point, the water or other fire retardant will fall to the ground. The distance from the jet engine to the point where the water or other fire retardant reaches the ground could be varied by controlling both the speed of the jet engine, as well as the attitude at which the jet exhaust is pointed. Since the jet exhaust is generally not aimed at the fire, but rather above it, the problem of fanning the fire with the high velocity wind produced by the jet engine is reduced or eliminated.

In this preferred embodiment, the jet engine would be mounted in a manner allowing rotation on a horizontal axis and a vertical axis, thus allowing the jet engine to be rotated in a vertical and a horizontal arc respectively. By so controlling the direction and attitude in which the jet exhaust is pointed, as well as the speed of the jet engine, the direction and distance in which the water or other fire retardant is carried can be controlled by an operator.

DETAILED DESCRIPTION

Figure 1:
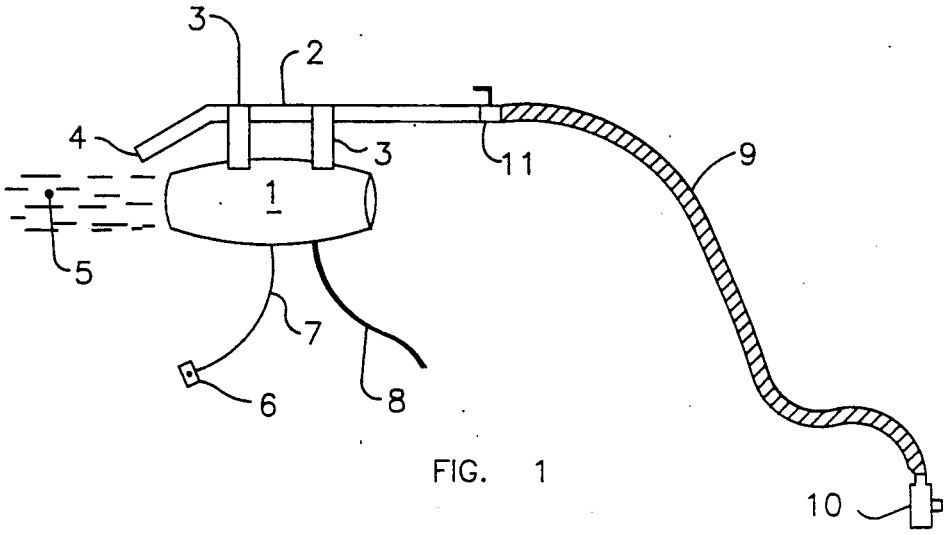
FIG. 1 is a perspective view of a jet engine with a conduit mounted indirectly thereon, shown with a pump for delivering water or another fire retardant through the conduit and into the jet exhaust.
Figure 2:
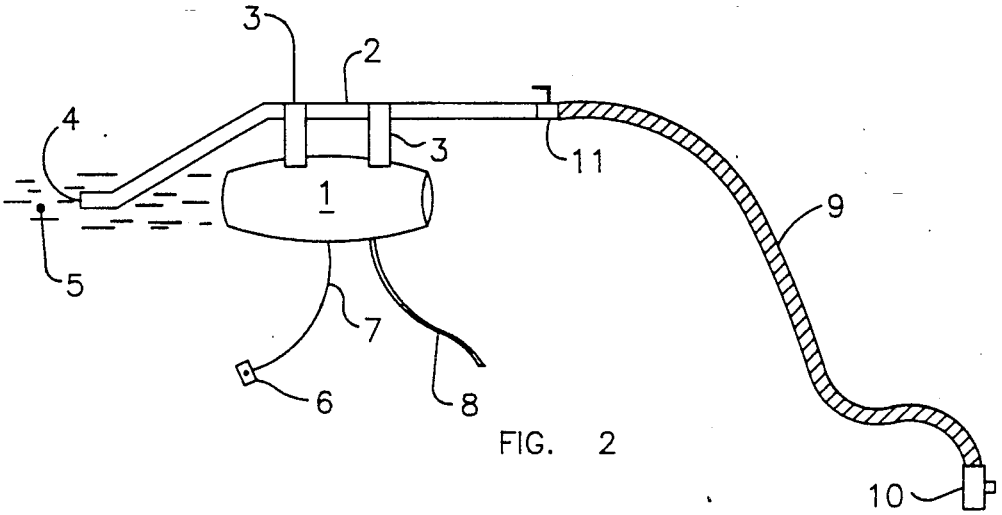
FIG. 2 is a variation of the device shown in FIG. 1.

As illustrated in FIGS. 1 or 2, the preferred embodiment of the present invention includes a jet engine 1 with a pipe 2 mounted onto the jet engine 1 with brackets 3. The pipe 2 leads into a nozzle or may simply terminate to an opening 4. In either case, water or other fire retardants passing through the pipe 2 toward the direction of the nozzle, or opening in the pipe 4, will, when under sufficient pressure, pass into the jet exhaust 5 when the jet engine 1 is in operation. The operating speed of the jet engine 1 is controlled with a throttle 6 connected to the jet engine 1 with linkage 7. A fuel pump delivers fuel to the jet engine 1 from a separate fuel tank, through a flexible fuel line 8. Either as parts of the invention, or as separate implements to be used with the invention, a pump 10, such as a pump driven by an engine, pumps water or other fire retardants through a flexable hose 9, and through a valve 11 before it goes into the pipe 2 and out the nozzle or opening in the pipe 4.

Figure 3:
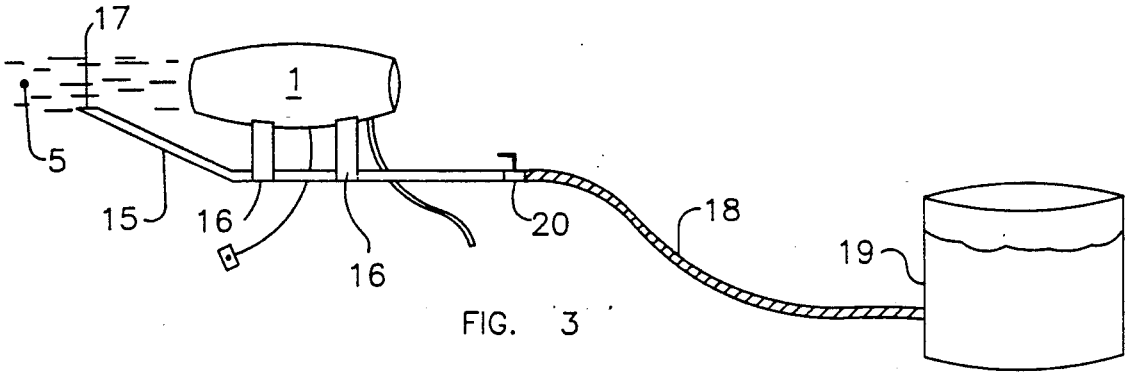
FIG. 3 is of a jet engine with a conduit opening in the area of the jet exhaust to utilize the venturi effect to draw water through the conduit into the jet exhaust.

Although the preferred embodiment relies on pumping or otherwise forcing the water into the jet exhaust, it is also possible to let the exhaust draw the water, or other fire retardant, into itself using the venturi effect. Since the pressure of a gas decreases as its velocity increases, fluids can often be drawn into gases that are moving at high velocity due to the difference between their pressure and atmospheric pressure. FIG. 3 illustrates an embodiment of the present invention in which a pipe or other conduit 15, which is mounted to the jet engine 1 with brackets 16, has an opening 17 in the area of the high velocity jet exhaust 5. The pressure difference between that of the jet exhaust 5 and atmospheric may allow water or other liquid fire retardants to be drawn through the conduit 15 and out the opening 17, into the jet exhaust 5. As illustrated, the water or other liquid fire retardant first comes from the reservoir 19, through the flexible suction hose 18 and the valve 20; though in practice, the reservoir may simply be a creek or a pond, for example.

Figure 4:
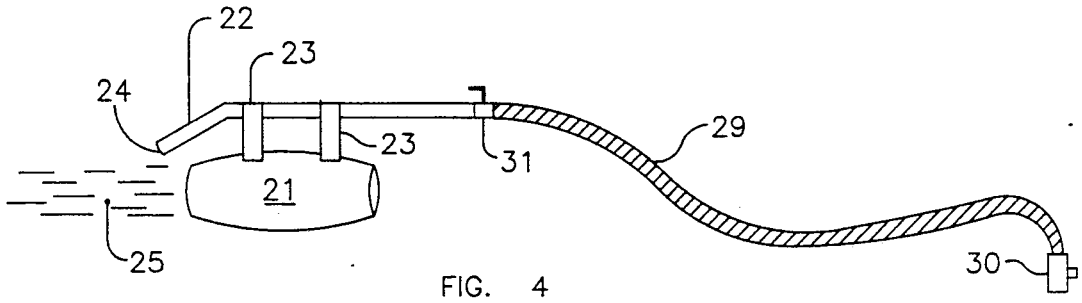
FIG. 4 depicts an unspecified wind-producing mechanism with a conduit mounted indirectly thereon, shown with a pump for delivering water or another fire retardant through the conduit and into the jet exhaust.
Figure 5:
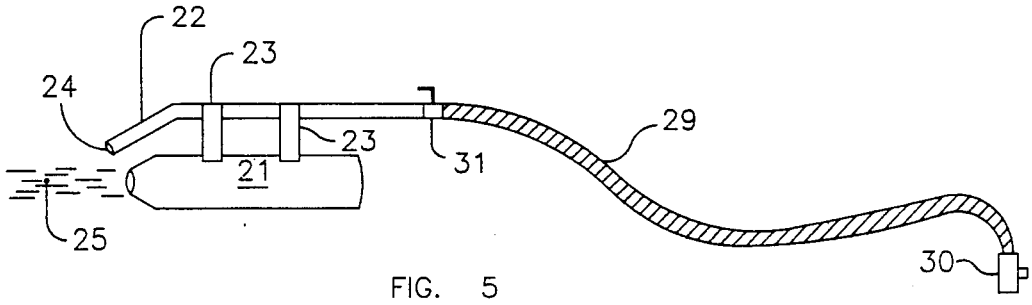
FIG. 5 is the same device depicted in FIG. 4 wherein the unspecified wind-producing mechanism is specifically a rocket engine.
Figure 6:
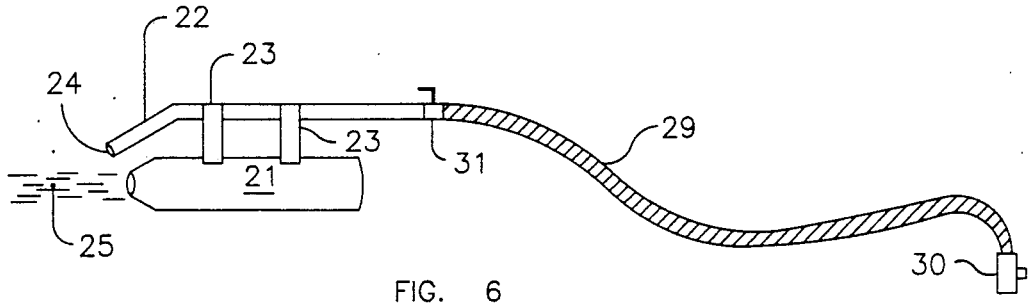
FIG. 6 is the same device depicted in FIG. 4 wherein the unspecified wind-producing mechanism is specifically a rocket.
Figure 7:
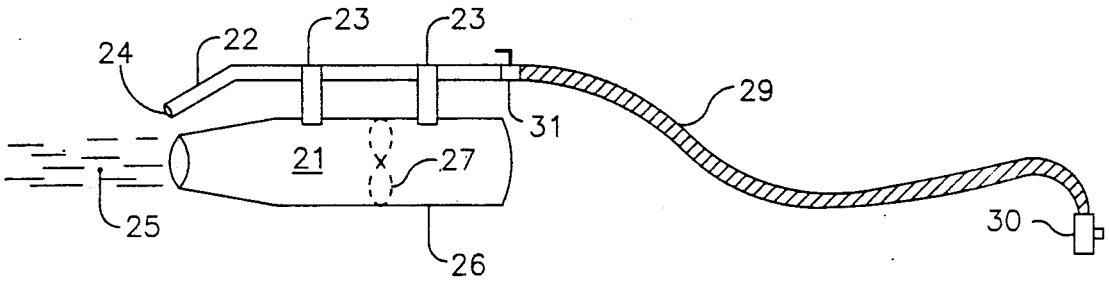
FIG. 7 is the same device depicted in FIG. 4 wherein the unspecified wind-producing mechanism is specifically a propeller or a fan in a shroud.

In the preferred embodiment, a jet engine was chosen as the mechanism to produce the exhaust or wind due to the extremely high velocity exhaust it can produce, and because it would be economically practical to operate under conditions of repeated and sustained use. There are, however, other wind producing mechanisms that can be utilized in this invention. For example, a rocket engine, or a rocket could replace the jet engine of the preferred embodiment, or of the embodiment utilizing the venturi effect. Similarly, a propeller or a fan with a power source for rotating the propeller or fan could be used to produce the wind used in this invention. Although the wind produced by a propeller or fan would be significantly lower in velocity than that produced by a jet engine or a rocket engine, such an embodiment would probably offer a significant economic advantage in manufacturing and maintenance costs. It may be desired to surround the outside of the fan or propeller with a shroud in order to better direct the wind so produced. FIG. 4 depicts the invention utilizing an unspecified wind-producing mechanism that represents either a rocket engine, rocket, fan or propeller, or any other mechanism that produces a wind; FIG. 5 depicts the invention wherein specifically a rocket engine is used as the wind-producing mechanism; FIG. 6 depicts the invention wherein a rocket is used as the wind-producing mechanism; and FIG. 7 depicts the invention wherein a propeller or fan surrounded by a shroud 26 is utilized as the wind-producing mechanism. In FIG. 7, the shroud 26 surrounds the propeller or fan 27 which is shown in phantom. The embodiments shown in FIGS. 4, 5, 6 and 7 have the same parts other than the various wind-producing mechanisms used in each embodiment. Accordingly, each identical part has been designated the same reference numeral in the four different embodiments. The following description refers to the embodiments depicted in FIGS. 4, 5, 6 and 7, with the various wind-producing mechanisms collectively referred to as "the wind-producing mechanism", and collectively designated as numeral 21.

A pipe 22 is mounted onto the wind-producing mechanism 21 with brackets 23. The pipe 22 leads into a nozzle or may simply terminate to an opening 24. In either case, water or other fire retardants passing through the pipe 22, toward the direction of the nozzle or opening 24 in the pipe 22, will, when under sufficient pressure, pass into the wind produced by the wind-producing mechanism 21 when the wind-producing mechanism 21 is in operation. Either as parts of the invention, or as separate implements to be used with the invention, a pump 30, such as a pump driven by an engine, pumps water or another fire retardant through a flexible hose 29, and through a valve 31, before it goes into the pipe 22 and out the nozzle or opening in the pipe 24.

Figure 8:
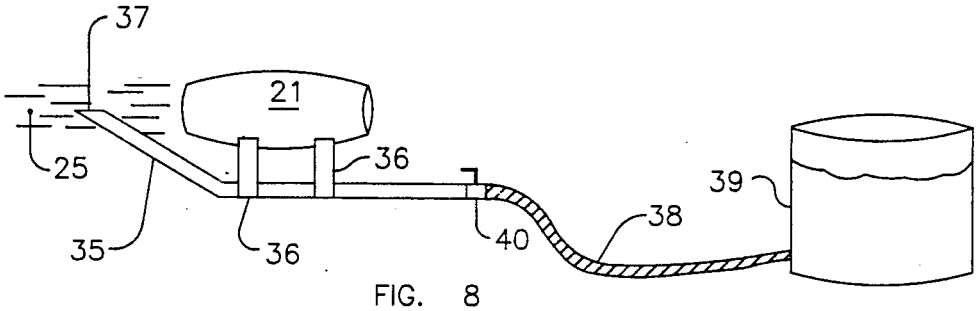
FIG. 8 is of a unspecified wind-producing mechanism with a conduit opening in the area of the wind produced by the wind-producing mechanism, to utilize the venturi effect to draw water or another liquid fire retardant into the wind so produced.
Figure 9:
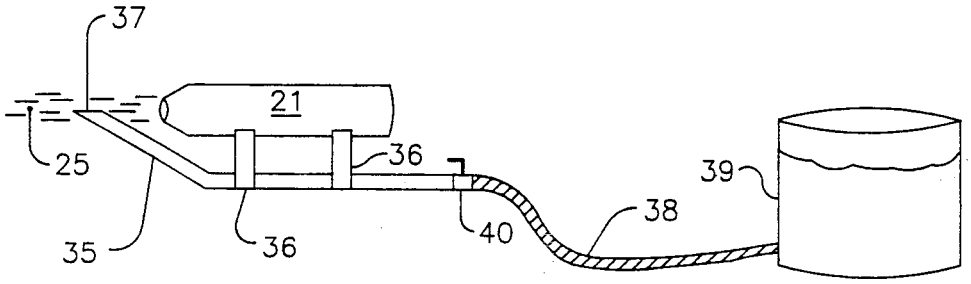
FIG. 9 is the same device depicted in FIG. 8 wherein the unspecified wind-producing mechanism is specifically a rocket engine.
Figure 10:
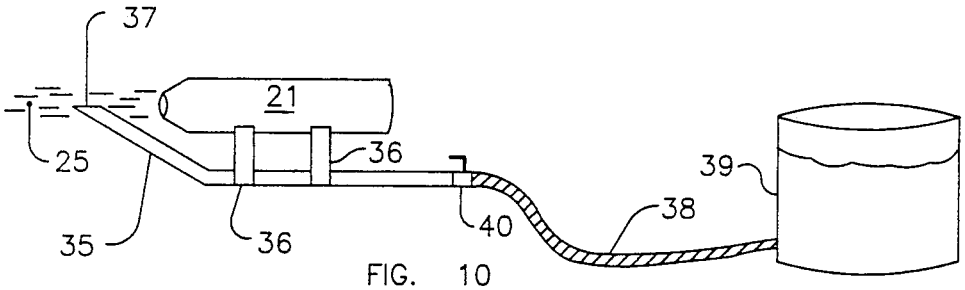
FIG. 10 is the same device depicted in FIG. 8 wherein the unspecified wind-producing mechanism is specifically a rocket.
Figure 11:
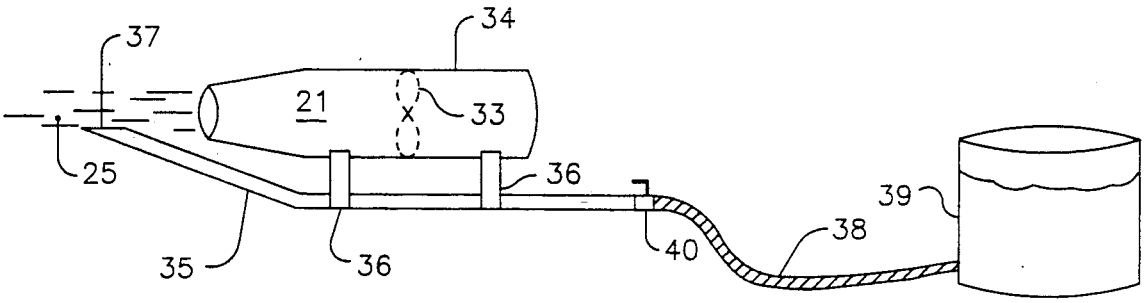
FIG. 11 is the same device depicted in FIG. 8 wherein the unspecified wind-producing mechanism is specifically a propeller or a fan in a shroud.
Figure 12:
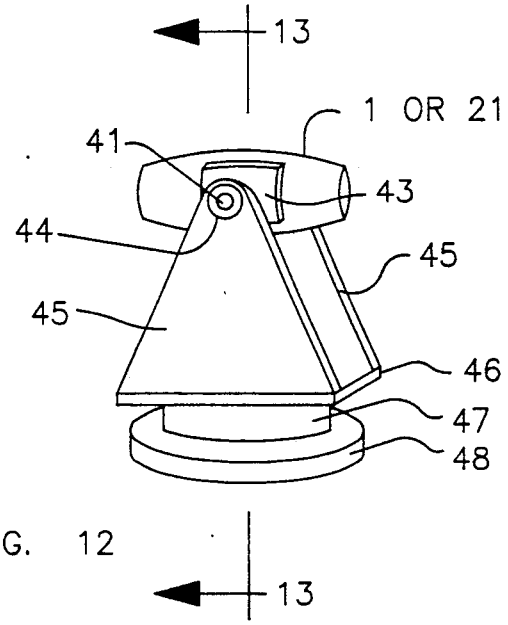
FIG. 12 is a perspective view of a jet engine, and alternately of another wind-producing mechanism, mounted in a manner allowing for horizontal axis rotation, and with some of the parts used to achieve vertical axis rotation.
Figure 13A:
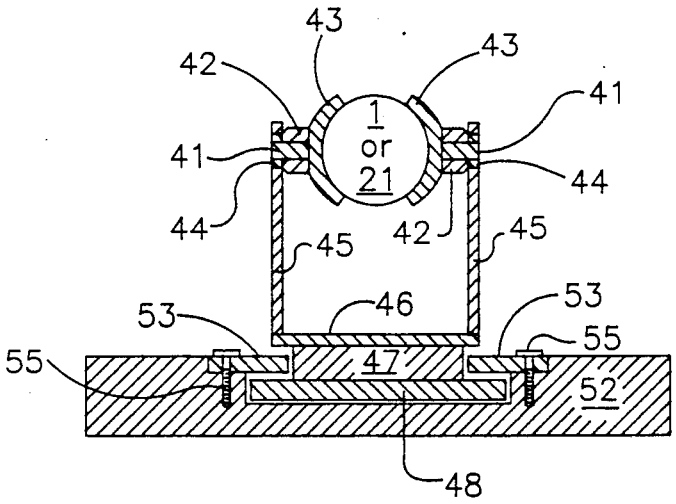
FIG. 13A is a cross-sectional view taken along line 13—13 of FIG. 12, showing the means for providing horizontal and vertical axis rotation of the jet engine or other wind-producing mechanism.
Figure 14:
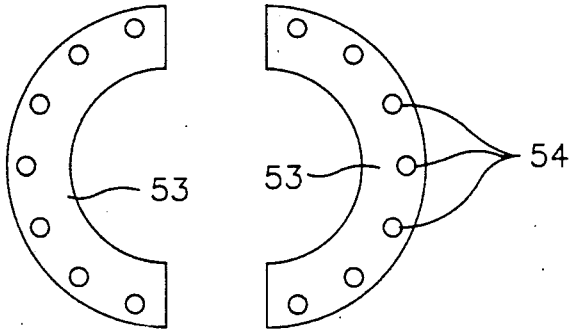
FIG. 14 is a top view of the rim caps.
Figure 15:
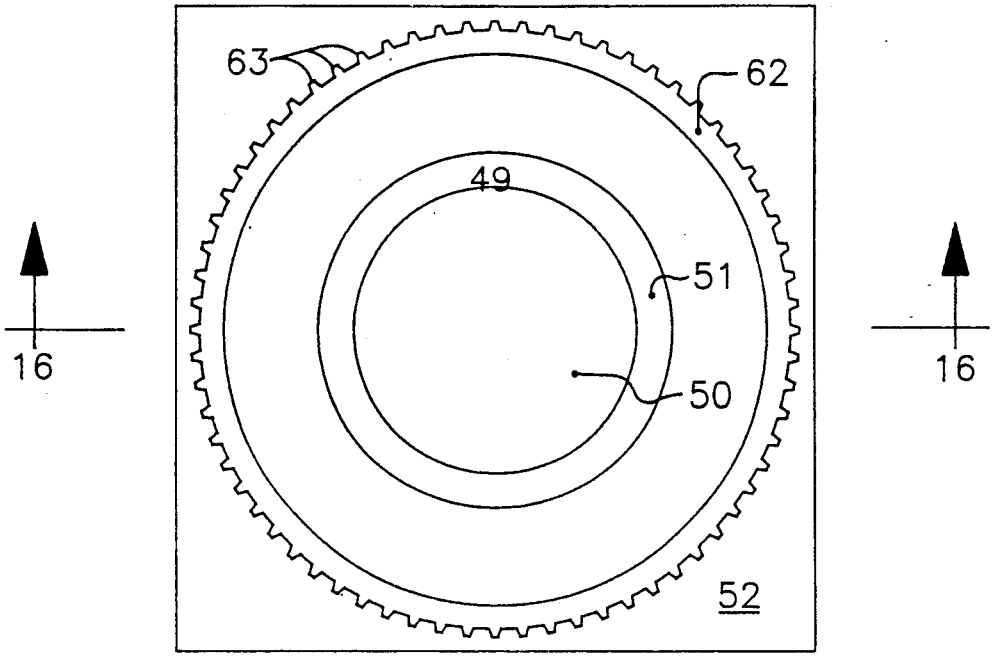
FIG. 15 is a top view of the base plate.
Figure 16:
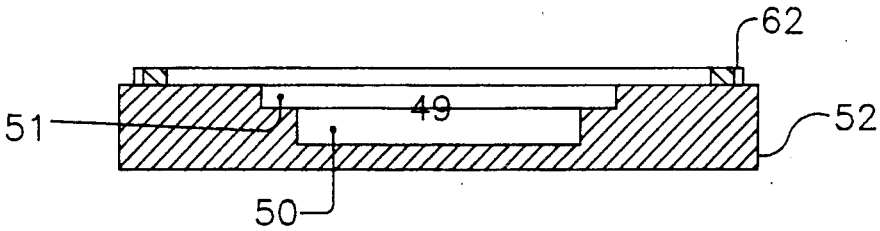
FIG. 16 is a cross-sectional view taken along line 16—16 of FIG. 15.

FIG. 8 depicts the invention utilizing an unspecified wind-producing mechanism that represents either a rocket engine, rocket, fan or propeller, or any other mechanisms that produces a wind; FIG. 9 depicts the invention wherein specifically a rocket engine is used as the wind producing mechanism; FIG. 10 depicts the invention wherein a rocket is used as the wind-producing mechanism; and FIG. 11 depicts the invention wherein a propeller or fan surrounded by a shroud 34 is utilized as the wind-producing mechanism. In FIG. 11, the shroud 34 surrounds the propeller or fan 33 which is shown in phantom. The embodiments shown in FIGS. 8, 9, 10 and 11 have the same parts other than the various wind-producing mechanisms used in each embodiment. Accordingly, each identical part has been designated the same refernce numeral in the four different embodiments. The following description refers to the embodiments depicted in FIGS. 8, 9, 10 and 11, with the various wind-producing mechanisms collectively referred to as "the wind-producing mechanism", and collectively designated as numeral 21.

A pipe or conduit 35 is attached to the wind-producing mechanism 21 with brackets 36. The pipe or conduit 35 has an opening 37 in the area of the wind 25 produced by the wind-producing mechanism 21. The pressure difference between that of the wind 25 and atmospheric may allow water or other liquid fire retardants to be drawn through the pipe or conduit 35 and out the opening 37, into the wind 25 produced by the wind-producing mechanism 21. The water or other fire retardant first comes from the reservoir 39, or another source of water or fire retardant, through the flexible suction hose 38 and the valve 40.

Figure 17:
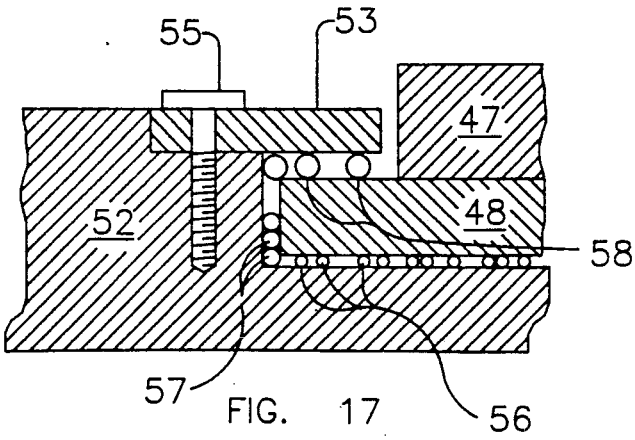
FIG. 17 is a cross-sectional view showing the function of the ball bearings in vertical axis rotation.
Figure 13B:
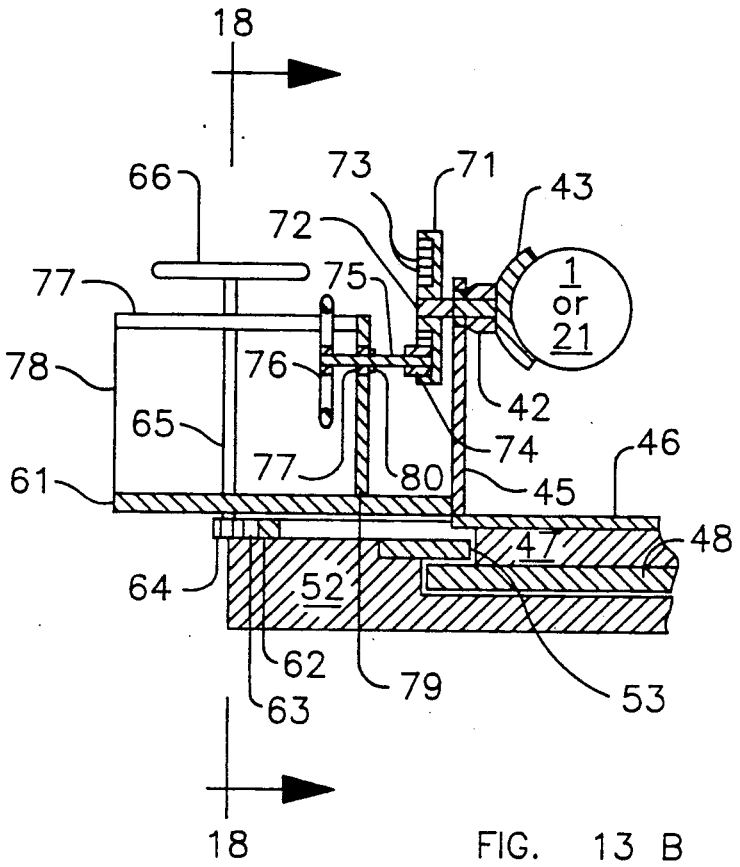
FIG. 13B is a cross-sectional view taken along line 13—13 of FIG. 12, extending further to show additionally a cross-sectional view of a preferred embodiment of a steering mechanism, while showing only a portion of the device depicted in FIG. 12.
Figure 18:
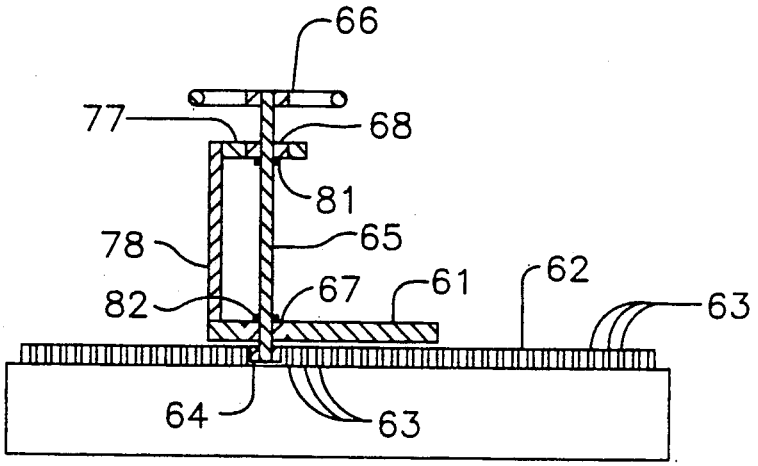
FIG. 18 is a cross-sectional view shown without depth taken along line 18—18 of FIG. 13B, showing the mechanism for activating rotation on the vertical axis.

In order to aim the jet exhaust 5, or the wind produced by any of the various wind-producing mechanisms 21, the jet engine 1 or wind-producing mechanism 21 is pivotally mounted on a horizontal axis and pivotally mounted on a vertical axis allowing rotation on horizontal and vertical axes respectively. Pivotal mounting on the horizontal axis is accomplished by pivot pins 41 on either side of the jet engine 1 or wind-producing mechanism 21, each pivot pin 41 being rigidly secured in a support bushing 42. The support bushings 42 are rigidly secured to one or more engine brackets 43, which in turn rigidly support the jet engine 1 or wind-producing mechanism 21 in a manner that does not damage it. Vertical supports 45 on each side of the jet engine 1 or wind-producing mechanism 21 have holes for reception of bushing 44. The two bushings 44 are rigidly secured in the two holes. The pins 41 fit securely in one of the bushings 44 in a manner allowing the pins 41 to rotate in the bushings 44. The bushings 44 may otherwise be bearings. The two vertical supports 45 are rigidly attached, at their bottoms, to a connection plate 46. In order to achieve rotation of the jet engine 1 or wind-producing mechanism 21 on the vertical axis, a circular mid-plate 47 is rigidly secured to the bottom of the connection plate 46. A circular bottom plate 48, which has a larger diameter than the circular mid-plate 47, is rigidly secured to the bottom of the circular mid-plate 47 with their respective centers aligned. The circular bottom plate 48 sits in the bottom portion 50 of the circular well 49 in the base plate 52. Two rim caps 53 are bolted into the upper portion 51 of the circular well 49, through holes 54 in the rim caps 53, with bolts 55. The rim plates 53 prevent the circular bottom plate 48 from tipping out of the circular well 49. Preferably, there are bearings in the spaces between the bottom of the circular well 49 and the bottom of the circular bottom plate 48; the outside of the circular bottom plate 48 and the outside of the lower portion 50 of the circular well 49; and the top of the circular bottom plate 48 and the bottom of the rim caps 53. In one example, illustrated in FIG. 17, loose ball bearings of three different sizes are placed in the spaces around the circular bottom plate 48, the smallest of these ball bearings 56 are placed below the circular bottom plate 48; the largest of the bearings 58 are placed above the circular bottom plate 48; and the mid-size bearings 57 are placed to the outside of the circular bottom plate 48. By arranging the loose ball bearings in this manner, no ball bearing can fall from its proper space to a space below.

In another embodiment, rotation of the jet engine on the horizontal axis is accomplished in the same manner as in the previous example, while rotation on the vertical axis employs this same means as well. This design calls for vertical supports that extend higher than those of the preferred embodiment, with the holes for receiving the bushings approximately midway between the top and bottom of the vertical supports. The vertical supports, being basically square or rectangular in shape, are bridged across the top as well as the bottom by connection plates, similar to the connection plate 46 of the preferred embodiment. A second pair of vertical supports extend upward from a base plate, to which they are rigidly attached, extending higher than the first pair of vertical supports. The second set are similarly bridged across the top by a connection plate. Vertical axis rotation in this example is accomplished in the same manner as horizontal rotation, wherein pins, bushings, and support bushings, similar to those designated as 41, 44 and 42 respectively, of the previous example, are installed between the two uppermost connection plates, and between the lower connection plate and the base plate.

In order to activate rotation on the vertical axis, in the preferred embodiment, an operators platform 61 is rigidly attached to the connection plate 46 or a vertical support 45, to the side of the jet engine 1 or wind-producing mechanism 21. A lower geared ring 62 is rigidly secured to the base plate 52 around the circular well 49. The gears 63 are on the outside of the lower geared ring 62. A lower pinion gear 64 is mounted on a vertical shaft 65 and meshes with the gears 63 of the lower geared ring 62. Mounted at the top of the vertical shaft 65 is a hand wheel 66. The vertical shaft 65 is supported by a bushing 67 which is rigidly secured in a hole in the operators platform 61; and a bushing 68, which is rigidly secured in a hole in the horizontal portion 77 of the outer platform wall 78. Bushings 67 and 68 allow the vertical shaft 65 to turn. Two rings 81 and 82, which are rigidly attached on the vertical shaft 65, hold the vertical shaft 65 in place. Rotation of the hand wheel 66 by an operator causes vertical axis rotation of the jet engine 1 or wind-producing mechanism 21.

In order to activate rotation on the horizontal axis in the preferred embodiment, a geared ring 71 is rigidly secured on a pin 72, which is in turn rigidly secured to the outside of one of the pins 41 so that their respective centers align. The gears 73 are on the inside of the ring 71. A horizontal pinion gear 74 is mounted on a horizontal shaft 75, and meshes with the gears 73 of the geared ring 71. Mounted at the outside of the horizontal shaft 75 is a hand wheel 76. The horizontal shaft 75 is supported by a bushing 77 which allows the horizontal shaft 75 to turn. The bushing 77 is rigidly secured in a hole in the inner platform wall 79. A ring 80 is rigidly secured on the horizontal shaft 75, holding the horizontal shaft 75 in place. Rotation of the hand wheel 76 by an operator causes horizontal axis rotation of the jet engine 1 or wind-producing mechanism 21.

In another embodiment employing a simpler method of aiming the jet engine 1 or wind-producing mechanism 21, a long handle is adjustably mounted onto the rear of the jet engine 1 or wind-producing mechanism 21, extending rearward from it. Directional control is achieved by moving the handle side to side, as by walking with it, while attitude control is achieved by moving the handle up and down. The adjustable mounting between the handle and the rear of the jet engine 1 or wind-producing mechanism 21 allows the angle of their junction, on the vertical plane, to be varied. This adjustment capability would be desirable since the range of up and down movement of the handle would be somewhat limited. The handle would be adjusted at the location of the fire to allow easy operation within the range of attitudes the jet engine 1 or other wind-producing mechanism 21 would be aimed, as determined by that particular fire.

Although the preferred embodiment calls for horizontal and vertical axis rotation of the jet engine or other wind-producing mechanism, it would be possible to use the present invention without vertical or horizontal axis rotation, or with rotation on one axis only. If, for example, the attitude or angle between the jet engine or other wind-producing mechanism and the ground was fixed at approximately 45 degrees, the distance that the water or other fire retardant is propelled could be governed entirely by throttle control. Such a fixed attitude may, in practice, even prove desirable for safety reasons, both in preventing accidental aiming of the device at personnel on the ground, and to prevent possible tipping of the entire unit due to changing attitudes of force against the carrying vehicle.

In an embodiment wherein the jet engine or other wind-producing mechanism is mounted in a manner that does not allow rotation on the vertical axis, the vehicle upon which the present invention rides could be maneuvered in order to aim the jet engine or other wind-producing mechanism. This type of mounting may be desirable when tipping of the carrying vehicle is a potential hazard. The unit may be mounted on a truck, for example, so that it will always point to the front or to the rear of the truck. Since any carrying vehicle can be much longer than it is wide, tipping of the vehicle on its end would be much more difficult than tipping it on its side. Such a rigid mounting with respect to its vertical axis could eliminate the hazard of the truck tipping on its side due to the thrust of the jet engine or other wind-producing mechanism.

In practice, this invention would probably be mounted on a truck, though it could also be mounted on a trailer or even a tractor. It is also conceivable that it may at times be desirable to transport the device to a remote location near a body of water, by helicopter.

It may be necessary to provide some additional support, other than that provided by the vehicle on which the device rides, in order to brace it against the force of the jet engine or other wind-producing mechanism. One example of such a support mechanism would be outriggers, such as those commonly used with backhoes.

It is also anticipated that if water is used as the fire retardant, it may be desired to mix a dye in the water to enable the operator and other observers to better see where the water is falling relative to the fire.

While a preferred embodiment and modifications thereto of the invention have been shown and described herein as best modes for carrying out the invention, it should be understood that changes and modifications may be made thereto without departing from the subject matter coming within the scope of the following claims, which claims I regard as my invention.

I claim:

1. A method of fire fighting comrising:

producing a gas stream with the exhaust of a jet engine;

aiming said gas stream above a fire, or above flammable material near a fire, so that said gas stream is not aimed at the flames of said fire;

directing water or another fire retardant into said gas stream so that said water or other fire retardant will become entrained in said gas stream and be transported some distance above the ground, so that at least some of said water or other fire retardant will fall from said gas stream in which said water or other fire retardant was entrained, onto said fire or flammable material near said fire.

2. A method according to claim 1 wherein said water or other fire retardant is directed into said gas stream by the use of a pump or by gravity feed.

3. A method according to claim 1 wherein said water or other fire retardant is directed into said gas stream through a conduit that opens into said gas stream, by allowing said water or other fire retardant to be forced through said conduit by the differential between atmospheric pressure and the lower pressure in said conduit resulting from the high velocity of said gas stream.

4. A method according to claims 1, 2, 3 wherein said jet engine is connected with a supporting base in such a manner that allows said jet engine to rotate relative to said supporting base on a generally vertical axis and/or a generally horizontal axis.

5. A method of fire fighting comprising:

producing a gas stream with the exhaust of a rocket or rocket engine;

aiming said gas stream above a fire, or above flammable material near a fire, so that said gas stream is not aimed at the flames of said fire;

directing water or another fire retardant into said gas stream so that said water or other fire retardant will become entrained in said gas stream and be transported some distance above the ground, so that at least some of said water or other fire retardant will fall from said gas stream in which said water or other fire retardant was entrained, onto said fire or flammable material near said fire.

6. A method according to claim 5 wherein said water or other fire retardant is directed into said gas stream by the use of a pump or by gravity feed.

7. A method according to claim 5 wherein said water or other fire retardant is directed into said gas stream through a conduit that opens into said gas stream, by allowing said water or other fire retardant to be forced through said conduit by the differential between atmospheric pressure and the lower pressure in said conduit resulting from the high velocity of said gas stream.

8. A method according to claims 5, 6 or 7 wherein said rocket or rocket engine is connected with a supporting base in such a manner that allows said rocket or rocket engine to rotate relative to said supporting base on a generally vertical axis and/or a generally horizontal axis.

9. A method of fire fighting comprising: using a mechanical means to produce a gas stream of sufficient velocity to entrain water or another fire retardant;

aiming said gas stream above a fire, or above flammable material near a fire, so that said gas stream is not aimed at the flames of said fire;

directing water or another fire retardant into said gas stream so that said water or other fire retardant will become entrained in said gas stream and be transported some distance above the ground, so that at least some of said water or other fire retardant will fall from said gas stream in which said water or other fire retardant was entrained, onto said fire or flammable material near said fire.

10. A method according to claim 9 wherein said gas stream is an air stream, and the means for producing said air stream is one or more propellers or fans.

11. A method according to claims 9 or 10 wherein said water or other fire retardant is directed into said gas stream by the use of a pump or by gravity feed.

12. A method according to claims 9 and 10 wherein said water or other fire retardant is directed into said gas stream through a conduit that opens into said gas stream, by allowing said water or other fire retardant to be forced through said conduit by the differential between atmospheric pressure and the lower pressure in said conduit resulting from the high velocity of said gas stream.

13. A method according to claims 9 or 10 wherein the means for producing said gas stream is connected with a supporting base in such a manner that allows said means to rotate relative to said supporting base on a generally vertical axis and/or a generally horizontal axis.

* * * * *

Disclaimer

5,046,564 — Thomas E. Poulsen, Jiggs, NV (US). HIGH VELOCITY FIRE FIGHTING NOZZLE. Patent dated September 10, 1991. Disclaimer filed March 21, 2008, by the inventor.

Hereby disclaims and dedicates to the Public all claims and entire term of said patent.

*(Official Gazette, April 7, 2009)*